US005193926A

United States Patent [19]

Kuzuya et al.

[11] Patent Number: 5,193,926

[45] Date of Patent: Mar. 16, 1993

[54] APPARATUS FOR RECORDING IMAGE COVERED BY PROTECTIVE MEDIUM

[75] Inventors: Susumu Kuzuya, Gifu; Seiji Shimizu; Mikio Kato, both of Nagoya; Yujiro Ishikawa, Toyota; Takashi Sakai, Nagoya; Eiji Yuki, Owariasahi, all of Japan

[73] Assignee: Brother Kogyo Kabushiki Kaisha, Aichi, Japan

[21] Appl. No.: 619,470

[22] Filed: Nov. 29, 1990

Related U.S. Application Data

[62] Division of Ser. No. 261,318, Oct. 24, 1988, Pat. No. 5,009,530.

[30] Foreign Application Priority Data

Dec. 21, 1987 [JP] Japan ..... 62-323429
Oct. 31, 1989 [JP] Japan ..... 62-167673

[51] Int. Cl.[5] ..... B41J 2/325

[52] U.S. Cl. ..... 400/719; 400/120; 400/615.2; 400/188; 156/384

[58] Field of Search ..... 400/120, 185, 611, 613, 400/615.2, 719; 101/288; 156/238, 240, 277, 383, 384, 385, 386, 387

[56] References Cited

U.S. PATENT DOCUMENTS 357,921 2/1887 Hamilton .
1,973,589 9/1934 Watson .

(List continued on next page.)

FOREIGN PATENT DOCUMENTS 116382 8/1984 European Pat. Off. .
0130612 1/1985 European Pat. Off. .
0148276 7/1985 European Pat. Off. .
0267890 11/1987 European Pat. Off. .
0272232 11/1987 European Pat. Off. .
0262595 4/1988 European Pat. Off. .
46-25843 9/1971 Japan .
51-11611 1/1976 Japan .
54-51610 4/1979 Japan .
56-53420 12/1981 Japan .
57-41961 3/1982 Japan .
0041979 3/1982 Japan .
28389 2/1983 Japan ..... 400/121
39578 3/1984 Japan .
165246 8/1985 Japan .
61-31260 2/1986 Japan .
61-148064 7/1986 Japan .
0192578 8/1986 Japan .
61-202852 9/1986 Japan .
63-159074 7/1988 Japan .

OTHER PUBLICATIONS

IBM Technical Disclosure Bulletin, "Photoconductor Winding", Goldstein et al., vol. 25, No. 8, pp. 4331–4332 (Jan. 1983).

IBM Technical Disclosure Bulletin, "Speed Enhancement to Check Inscriber", Tulp et al., vol. 26, No. 8, pp. 3982–3983 (Jan. 1984).

IBM Technical Disclosure Bulletin, "Document Alignment with Conical Pressure Roll", vol. 31, No. 3, p. 84, (Aug., 1988).

*Primary Examiner*—David A. Wiecking
*Attorney, Agent, or Firm*—Oliff & Berridge

[57] ABSTRACT

A recording apparatus including an apparatus body having a front section on the operator's side and a rear section remote from the operator's side, a medium feeding device supported by the apparatus body, for feeding a substantially transparent recording medium along a predetermined feed path defining a boundary between the front and rear sections, such that one of opposite surfaces of the medium faces the operator's side, a recording device disposed in the rear section of the apparatus body, for recording an image on the other surface of the medium, and a control device for controlling the recording device such that the image is laterally reversed as viewed in a first direction from the recording device toward the above-indicated other surface of the medium, with respect to a nominal desired image as viewed in a second direction from the front section toward the one surface of the medium, whereby the laterally reversed image is seen as the nominal desired image when viewed in the second direction.

24 Claims, 9 Drawing Sheets

U.S. PATENT DOCUMENTS 2,254,299 9/1941 Leger et al. .
2,366,022 12/1944 Handley .
3,572,601 3/1971 Miller .
3,583,540 6/1971 Bernard .
3,587,810 6/1971 Alper .
3,664,481 5/1972 Dreimanis et al. .
3,768,619 10/1973 Lewis .
3,854,229 12/1974 Morgan .
3,954,261 5/1976 Greene et al. .
4,078,485 3/1978 Guthrie .
4,243,330 1/1981 Wallace et al. .
4,419,175 12/1983 Bradshaw et al. ..... 156/554
4,488,828 12/1984 Ohtsuki ..... 400/82
4,504,837 3/1985 Toyoda et al. .
4,544,289 1/1985 McGourty et al. .
4,548,523 10/1985 McGourty et al. .
4,557,617 12/1985 Richardson et al. ..... 400/208
4,564,411 1/1986 Holzer .
4,568,951 2/1986 Hasegawa et al. .
4,586,834 5/1986 Hachisuga et al. .
4,595,305 6/1986 McGourty et al. .
4,611,936 9/1986 Yasui .
4,652,154 3/1987 Horiya et al. .
4,661,001 4/1987 Takai et al. .
4,699,381 6/1987 Nakajima .
4,699,531 10/1987 Ulinski, Sr. et al. .
4,793,724 12/1988 Battles .
4,818,126 4/1989 Brooks et al. .
4,844,770 7/1989 Shiraishi et al. .

APPARATUS FOR RECORDING IMAGE COVERED BY PROTECTIVE MEDIUM

This is a division of application Ser. No. 07/261,318 filed Oct. 24, 1988, now U.S. Pat. No. 5,009,530, issued Apr. 23, 1991.

BACKGROUND OF THE INVENTION

1. Field of the Invention

The present invention relates in general to a recording apparatus for printing an image such that the printed image is protected by a protective layer, and more particularly to a printer capable of printing an image such that the image printed on a recording medium such as a tape is covered by a protective covering tape, or such that the image is protected by the recording medium per se.

2. Discussion of the Prior Art

A tape printer for printing on a tape rather than on an ordinary recording sheet is known. The tape printer usually has a tape feeding device for feeding the tape in its longitudinal direction, and a printing mechanism for effecting printing on the tape.

However, this type of tape printer does not have a function of protecting the printed surface of the tape. The printed image on the tape therefore tends to be subject to partial or complete erasure due to rubbing or frequent contact of the printed surface. Further, the printed image may be blurred or erased due to exposure to some chemical materials. For example, the printed tape segments are stuck on bottles which contain pharmaceuticals, in order to identify the contents of the bottles. In this case, the printed surface of the tape segments used as such labels may be exposed to the pharmaceuticals. In any event, the image printed on the exposed surface of the tape may be partially or totally erased, blurred or otherwise influenced by the environments.

To overcome the above drawbacks, a recording apparatus is proposed as disclosed in laid-open publications Nos 60-13551, 61-31260 and 61-148064 of unexamined Japanese Patent Applications. In the disclosed recording apparatus, a desired image is printed by recording means such as a thermal print head, on a transparent recording medium such as a transparent film sheet, by means of an inking material such as an ink ribbon, such that the printed image as viewed in the direction toward the printed surface is laterally reversed with respect to the corresponding nominal image normally viewed by the reader.

The laterally reversed image printed on one surface of the recoding medium is seen as the nominal image when viewed through the thickness of the medium, in the direction toward the other surface of the medium.

In the recording apparatus of the type indicated above, the recording means is positioned on the operator's side with respect to the recording medium, namely, positioned so as to print an image on the surface of the recording medium which faces the operator. Accordingly, the printed image as viewed by the operator is laterally reversed, and the operator feels difficulty in perceiving the printed image.

SUMMARY OF THE INVENTION

It is therefore an object of the present invention to provide a recording apparatus for producing a suitably protected printed image, in a manner that permits the operator to easily perceive the image during the printing.

The above object may be achieved according to the principle of the present invention, which provides a recording apparatus, comprising: an apparatus body having a front section on the side of an operator of the apparatus and a rear section remote from the operator's side; medium feeding means supported by the apparatus body, for feeding a substantially transparent recording medium along a predetermined feed path defining a boundary between the front and rear sections, such that one of opposite surfaces of the medium faces the operator's side; recording means disposed in the rear section of the apparatus body, for recording an image on the other surface of the medium; and control means for controlling the recording means such that the image is laterally reversed as viewed in a first direction from the recording means toward the above-indicated other surface of the medium, with respect to a nominal desired image as viewed in a second direction from the front section toward the one surface of the medium, whereby the laterally reversed image is seen as the nominal desired image when viewed in the second direction.

In the recording apparatus of the present invention constructed as described above, the image is recorded on the back surface of the medium as viewed from the operator's side such that the image is laterally reversed, as viewed from the recording means toward the back surface. However, the printed image on the back surface of the transparent medium is viewed by the operator as the nominal normal image, through the thickness of the transparent medium. Accordingly, the image can be readily perceived by the operator, during the printing of the image. Where the medium is bonded to a surface of a desired object, with an adhesive applied to the printed back surface of the medium, the medium itself serves as a protective covering for the printed image.

It will be understood that the terms "front section", "rear section" and "back surface" are used herein for easy understanding of the invention. Namely, these words apply when the recording medium is printed while the printed surface is held substantially vertically. In this case, the recording means is disposed in the rear section of the apparatus body, and the image is printed on the back surface of the medium. However, the principle of the present invention may be practiced where the recording medium is held substantially horizontally to print an image on the lower surface of the medium. In this case, the upper and lower sections of the apparatus body respectively correspond to the above indicated terms "front section" and "rear section", and the lower surface of the medium corresponds to the above-indicated term "back surface".

In one form of the present invention, the recording apparatus further comprises operator's controlled data input means disposed in a portion of the apparatus body in front of the medium feeding means and the recording means, for entering data representative of the image recorded by the recording means.

In another form of the invention, the apparatus further comprises backing means disposed at a position along the predetermined feed path downstream of the recording means as viewed in a direction of feed of the medium, for backing the other surface, i.e., back surface of the medium with a backing layer.

In a further form of the invention, the apparatus further comprises means having an inking material, and the recording means is adapted to record the image by depositing the inking material on the above-indicated other surface of the medium. The recording medium permits the inking material to be transferred to a surface of an object, when the above-indicated other surface of the medium and the inking material are forced into contact with the surface of the object, with a pressure applied to the inking material through the medium.

In a still further form of the invention, the recording medium consists of a recording tape, and the medium feeding means comprises a tape feeding mechanism for feeding the recording tape in a lateral direction of the apparatus body.

According to one feature of the above form of the invention, the tape feeding mechanism is adapted to feed the recording tape in a leftward direction as viewed in the above-indicated second direction. According to another feature of the same form of the invention, the apparatus further comprises a cutter mechanism for cutting the recording tape, which mechanism is disposed at a position along the predetermined feed path downstream of the recording medium as viewed in a direction of feed of the recording tape.

According to a further feature of the same form of the invention, the apparatus further comprises a pair of presser rollers disposed at a position along the predetermined feed path downstream of the recording means, for superposing a backing tape on a recorded portion of the recording tape on which the laterally reversed image has been recorded. The presser rollers define therebetween a pressure nip through which are passed the recorded portion of the recording tape and the backing tape which have been superposed, whereby the recorded portion and the backing tape are secured to each other.

In one arrangement according to the above feature of the invention, the tape feeding mechanism comprises the pair of presser rollers, and a drive source for rotating at least one of the presser rollers. In this instance, the apparatus further comprises switching means for selectively placing the presser rollers in a first position in which the above-indicated pressure nip is established, and a second position in which the presser rollers are spaced apart from each other.

In another arrangement according to the same feature of the invention, the backing tape comprises a substrate, two adhesive layers formed on opposite surfaces of the substrate, and a release layer provided on one of the two adhesive layers which is remote from the recording tape when the recorded portion of the recording tape and the backing tape are superposed on each other. In this case, the apparatus may further comprise a cutting mechanism disposed at a position along the medium feed path downstream of the recording means. The cutting mechanism comprises a completely cutting blade for cutting both the recording tape and the backing tape, and a partially cutting blade for cutting only the backing tape.

According to another aspect of the invention, there is provided a recording apparatus comprising: a tape feeding device for feeding a recording tape in a longitudinal direction of the tape; a recording head for recording an image on one of opposite surfaces of the recording tape; and covering means for covering the above-indicated one surface of the recording tape with a substantially transparent covering layer.

In the above recording apparatus also constructed according to the invention, the printed surface of the recording tape is protected by the covering layer which has a sufficient degree of transparency. Therefore, the printed image can be viewed by unaided eye through the transparent covering layer. Further, the image is protected by the covering layer against rubbing or contact, or exposure to pharmaceuticals or other chemical substances, and is consequently free of partial or complete erasure. Thus, the instant recording apparatus assures comparatively improved life expectancy of the printed image, and permits wider use of the recorded tape.

In one form of the above aspect of the invention, the recording head is adapted to record the image on the recording tape by superposing an ink ribbon on the recording tape and transferring an inking material from the ink ribbon to the above-indicated one surface of the recording tape.

According to one feature of the above form of the invention, the apparatus may further comprise recording tape supply means for supplying the recording tape, covering tape supply means for supply the covering tape, ink ribbon supply means for supplying the ink ribbon, and ink ribbon feeding means for feeding the ink ribbon past the recording head. The recording tape supply means includes a rotatably supported supply spool having a roll of the recording tape mounted thereon, and is adapted to apply a resistance to a feeding movement of the recording tape by the tape feeding device. The covering tape supply means includes a rotatably supported supply spool having a roll of the covering tape mounted thereon, and is adapted to apply a resistance to a feeding movement of the covering tape. The ink ribbon supply means includes a rotatably supported supply spool having a roll of the ink ribbon mounted thereon, and is adapted to apply a resitance to a movement of the ink ribbon. The ink ribbon feeding means includes a rotatably supported take-up spool for taking up the ink ribbon. In this case, the covering means comprises a pair of presser rollers disposed downstream of the recording head as viewed in a direction of feed of the recording tape by the tape feeding device, for superposing a covering tape on a recorded portion of the recording tape on which the image has been recorded. The presser rollers define therebetween a pressure nip through which are passed the recorded portion of the recording tape and the covering tape which have been superposed, whereby the recorded portion and the covering tape are secured to each other. The tape feeding device comprises a drive source for rotating at least one of the presser rollers for feeding the recording tape and the covering tape whereby the presser rollers serve as part of the tape feeding device.

BRIEF DESCRIPTION OF THE DRAWINGS

The above and optional objects, features and advantages of the present invention will become more apparent by reading the following detailed description of presently preferred embodiments of the invention, when considered in connection with the accompanying drawings, in which.

DETAILED DESCRIPTION OF THE PREFERRED EMBODIMENTS

Figure 1:
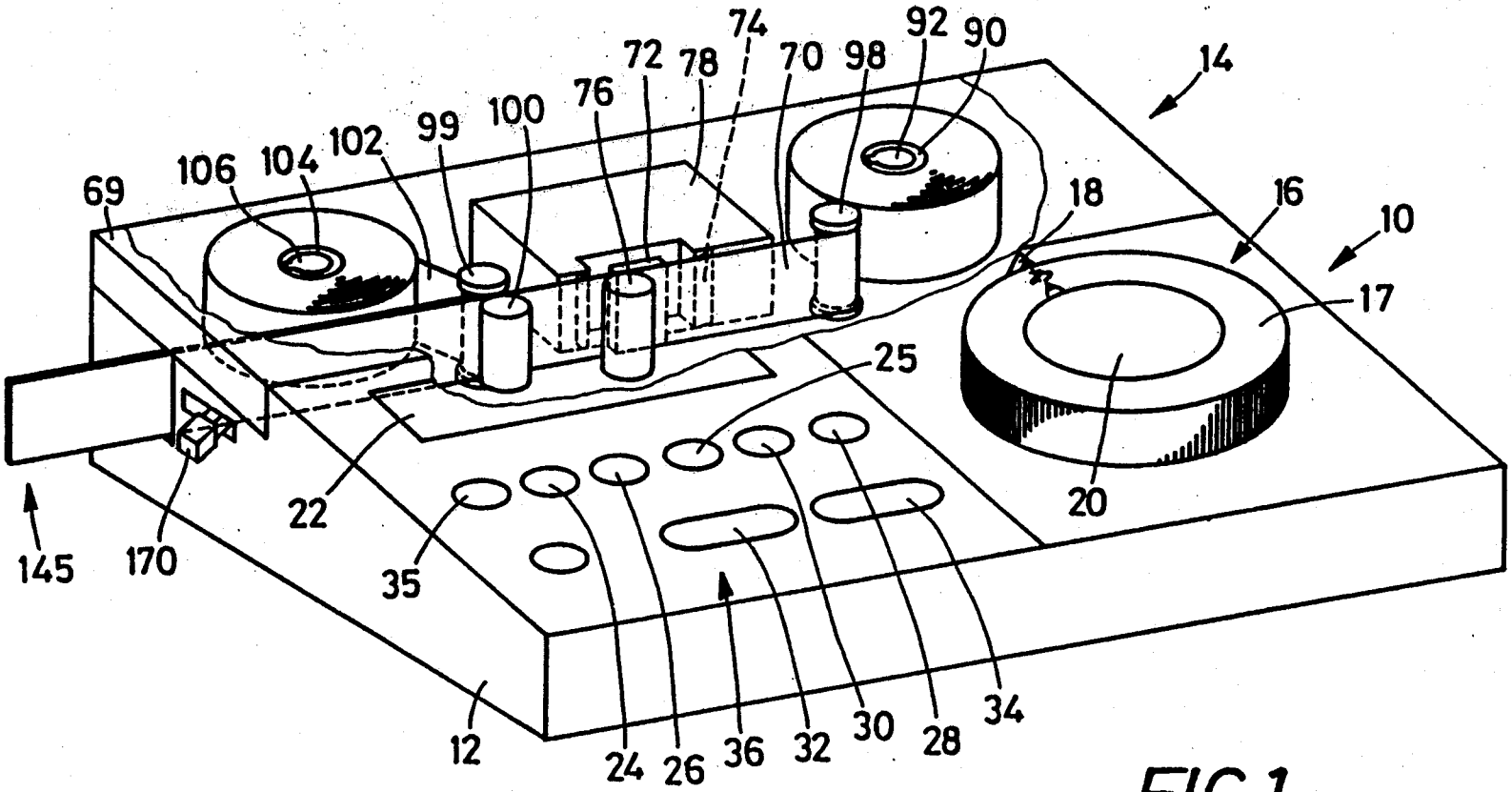
FIG. 1 is a perspective view of one embodiment of a recording apparatus of the present invention in the form of a tape printer.

Referring first to FIG. 1, there is shown a general arrangement of the tape printer according to one embodiment of the invention. The tape printer has an apparatus body 12 which consists of a front section incorporating a data input section 10, and a rear section incorporating a printing section 14 adapted to effect printing according to input data entered through the data input section 10. The data input section 10 has a data entry member in the form of a character entry dial 16 which is rotatable to enter desired characters to be printed. The character entry dial 16 assumes an annular shape, and has an annular indicator surface 17 on which are provided two circular rows of indicia such that the indicia of each row are equally spaced apart from each other along the annulus of the indicator surface 17. The indicia represent a multiplicity of characters such as letters (Japanese "kana" letters, English alphabetic letters and numerals), symbols and graphic representations.

The data input section 10 further has a pointer 18 disposed adjacent to the outer circumference of the character entry dial 16. The pointer 18 is used to zero the dial 16, and position the dial 16 for selecting the desired character. Inside the character entry dial 16, there is concentrically disposed a CONFIRMATION key 20 which is operated to enter the selected character. When one of the two characters of the outer and inner rows of indicia which are aligned with the pointer 18 is desired, the CONFIRMATION key 20 is operated, together with an OUT/IN selector key 25 (which will be described). As a result, the character of the outer or inner row of indicia selected by the OUT/IN selector key 25 is selected and entered as the desired character. The currently designated characters aligned with the pointer 18 are sequentially indicated on a liquid crystal display 22 provided on the data input section 10.

The data input section 10 further has various function keys 36 disposed adjacent to the character entry dial 16. The function keys 36 include a SPACING selector key 24 for designating the spacing between successive characters to be printed, a SIZE selector key 26 for designating the size of the character, the above-indicated OUT/IN selector key 25, an INSERT key 28, a DELETE key 30, a KANA/CHINESE CHARACTER conversion key 32 for converting an entered "kana" word into a Chinese character word, a SEARCH key 34 for searching and designating a desired Chinese character or word, and a PRINT key 35 for effecting the printing of the entered data.

There will next be described in detail the character entry dial 16 and the CONFIRMATION key 20.

Figure 3:
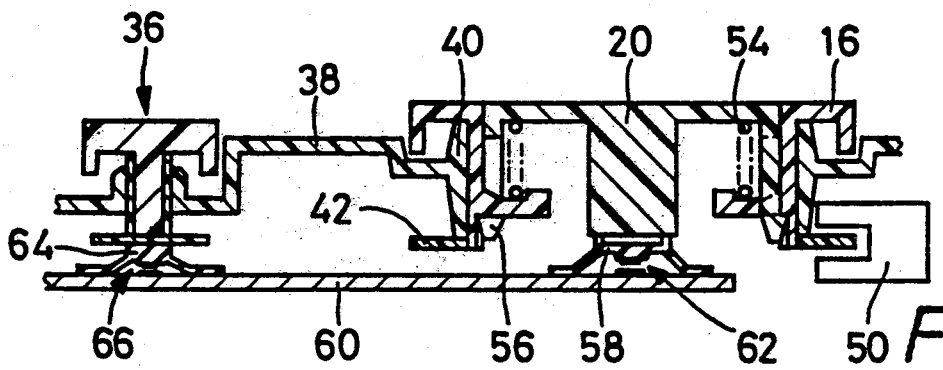
FIG. 3 is an elevational view in cross section of a character entry dial and its vicinity.

As shown in FIG. 3, the character entry dial 16 is rotatably supported within a cylindrical portion 40 of a covering 38 which forms a part of the apparatus body 12. The dial 16 has an upper operating portion which protrudes from the covering 38. A slit disc 42 is secured to the lower end of the character entry dial 16 such that the disc 42 is concentric with the dial 16.

Figure 4:
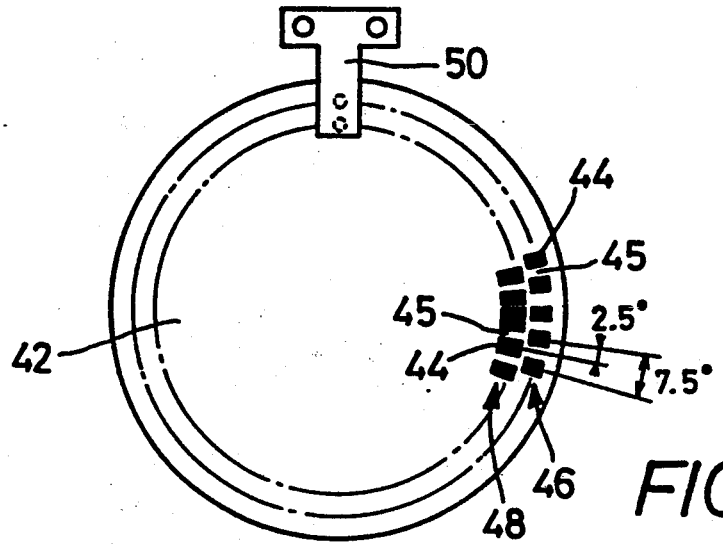
FIG. 4 is a fragmentary plan view of the arrangement of FIG. 3.
Figure 5:
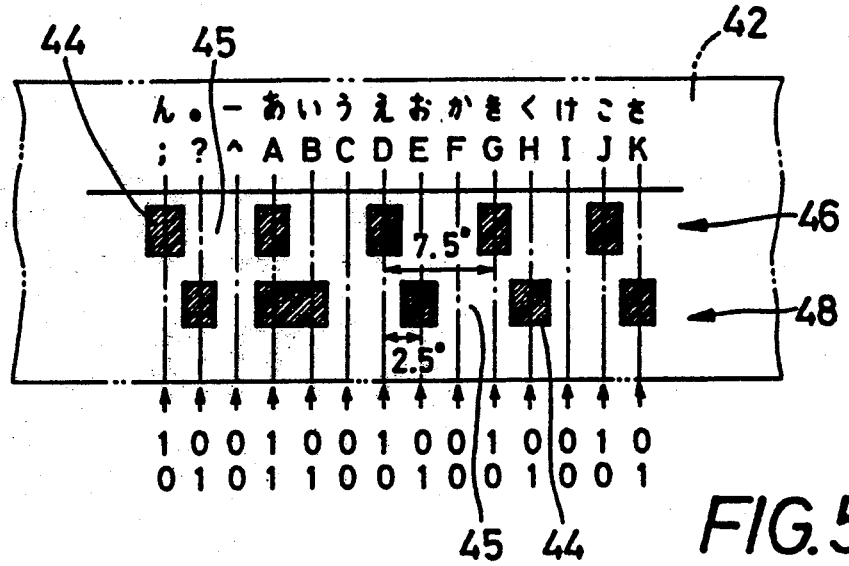
FIG. 5 is a schematic representation illustrating a portion of an optical grid arrangement of the character entry dial, when viewed linearly, in connection with the states of detection signals obtained by a photoelectric sensor.

As indicated in FIG. 4, the slit disc 42 has a circular optical grid arrangement formed by silk-screen printing. The optical grid arrangement has optically opaque grids 44, and optically transparent slits 45 formed between the adjacent opaque grids 44. A portion of this optical grid arrangement is illustrated in FIG. 5, in which actually circular outer and inner rows 46, 48 of the grids and slits 44, 45 are shown so as to extend linearly, for convenience' sake. The outer row 46 is adapted to detect the angular phase of the character entry dial 16, while the inner row 48 is adapted to detect the rotating direction of the dial 16. In the present embodiment, the grids 44 of the outer row 46 are evenly spaced apart from each other at an angular interval of 7.5°, and the grids 44 of the inner row 48 are offset from the corresponding grids 44 of the outer row 46 by an angle of 2.5° in the clockwise direction as viewed in FIG. 5. A photoelectric sensor 50 for optically detecting the grids and slits 44, 45 of the outer and inner rows 46, 48 is provided such that a light-emitting element on one side of the sensor 50 and a light-sensitive element on the other side of the sensor are positioned on the opposite surfaces of the slit disc 42, as indicated in FIG. 3.

The photoelectric sensor 50 is adapted to produce a signal "1" for each grid 44, and a signal "0" for each slit 45. These signals are applied to a microcomputer of a control system of the instant tape printer, as described later in greater detail. When the dial 16 is positioned such that the indicia "♣A" are aligned with the pointer 18 as indicated in FIG. 1, the states of the signals produced by the sensor 50 are "1" for both of the outer and inner rows 46, 48. This output "1, 1" of the sensor 50 is obtained only when the indicia "♣A" are aligned with the pointer 18. In this position, the dial 16 is zeroed. If the next output of the sensor 50 obtained by an incremental rotation thereof from this zero point is "0, 0", this indicates that the dial 16 has been rotated in the clockwise direction as viewed in FIG. 1. If the next output is "0, 1", on the other hand, this means that the dial 16 has been rotated in the counterclockwise direction. Thus, the rotating direction of the dial 16 can be determined. Further, the angular phase of the dial 16 and therefore the indicia (characters) aligned with the pointer 18 can be determined by counting the pulse signals from the sensor 50 which correspond to the grids 44 and slits 45 on the slit disc 42.

As shown in FIG. 3, the CONFIRMATION key 20 is fitted in the annular character entry dial 16 such that the key 20 is axially slidable relative to the dial 16. While the key 20 is biased by a spring 54 in a direction that causes the key 20 to protrude from the dial 16, the key 20 is held in position by abutting contact of a tab 56 of the key 20 with the lower end portion of the dial 16. The CONFIRMATION key 20 has an elastically yieldable rubber contact plate 58 fixed to its lower end. A contactor 62 is diposed on a baseplate 60 of the data input section 10, such that the contactor 62 is located right below a central portion of the contact plate 58. The contact plate 58 also serves as a dust boot surrounding the contactor 62, and is rotatable while its lower end is held in contact with the surface of the baseplate 60. The function keys 36 indicated above have a construction similar to that of the CONFIRMATION key 20. Each function key 36 has a contactor 66 disposed between a corresponding contact plate 64 and the baseplate 60, so as to produce a signal when operated.

Figure 2:
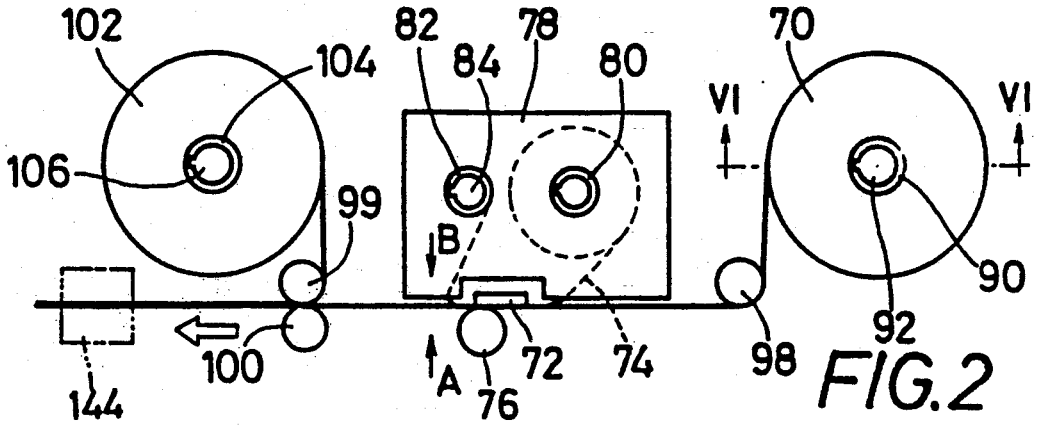
FIG. 2 is a fragmentary schematic plan view of the tape printer of FIG. 1.

Referring back to FIG. 1, the printing section 14 is covered by a transparent casing 69 which has an open and a closed position. This casing 69 constitutes a part of the apparatus body 12. In the printing section 14, a recording medium in the form of a substantially transparent tape 70 (hereinafter simply called "transparent tape") is fed leftward (as viewed in FIG. 1) in its longitudinal direction, along a predetermined feed path which defines a boundary between the data input and printing sections 10, 14 (front and rear sections). On this transparent tape 70, an image is printed by a recording device in the form of a thermal head 72. This thermal head 72 has a row of heat-generating elements (not shown) which extends in a direction normal to the direction of feed of the tape 70. As shown in FIG. 2, the thermal head 72 is held in pressed contact with a medium feeding roller in the form of a platen roller 76, via the transparent tape 70 and an ink ribbon 74 which has an inking material. The platen roller 76 is supported rotatably about an axis which is parallel to the row of the heat-generating elements of the thermal head 72.

For the sake of description, it is assumed that the surface of the transparent tape 70 that is viewed in a direction A of FIG. 2 or on the operator's side is referred to as a front surface, while the surface of the tape 70 viewed in a direction B is referred to as a back surface. The thermal head 72 is located on the side facing the back surface of the transparent tape 70. With the appropriate heat-generating elements of the thermal head 72 energized so as to form a corresponding character pattern, the inking material in the corresponding local portions of the ink ribbon 74 is transferred to the back surface of the transparent tape 70 while the tape 70 is fed in the leftward direction as seen in FIG. 1. In this manner, the image is printed on the back surface of the tape 70 such that the printed image as viewed in the direction B is laterally reversed with respect to a nominal desired image as viewed in the direction A.

It is noted that while the transparent tape 70 is fed leftward as viewed on the operator's side (in the direction A) as in an ordinary tape printer, the tape 70 is fed rightward as viewed in the direction B from the thermal head 72 toward the back surface of the tape 70. In this sense, the tape feeding direction as viewed from the thermal head 72 is different from the feeding direction in the ordinary tape printer.

A roll of the ink ribbon 74 is accommodated in a ribbon cassette 78. More specifically, the ink ribbon 74 is supplied from the roll mounted on a supply spool 80 in the ribbon cassette 78 as shown in FIG. 2, and is fed between the thermal head 72 and the platen roller 76. The used length of the ink ribbon 74 is rewound on a take-up spool 82 in the ribbon cassette 78.

The transparent tape 70 is wound as a roll on a supply spool 90. As is apparent from FIG. 6, the supply spool 90 is fit on a spool shaft 92 and is rotatable with the spool shaft 92. Between this spool shaft 92 and a baseplate 93 of the printing section 14, there is disposed a spring washer 94 which applies a suitable amount of resistance to the rotation of the spool 90, whereby a free rotation of the roll of the transparent tape 70 is avoided. Alternative means for applying a resistance to the rotation of the supply spool 90 is illustrated in FIGS. 7 and 8. This alternative means employs a spiral spring 95 which is fixed at its one end to a fixed member 96. The other end of the spiral spring 95 is pre-loaded in pressed contact with the inner surface of a cylindrical portion 97 formed as an intergral part of the spool shaft 92. A friction force between the spiral spring 95 and the surface of the rotating cylindrical portion 97 provides a resistance to the rotating movement of the supply spool 90.

Figure 6:
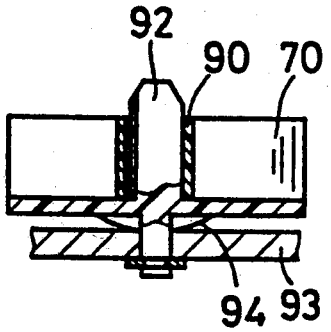
FIG. 6 is a cross sectional view taken along line VI—VI of FIG. 2.
Figure 7:
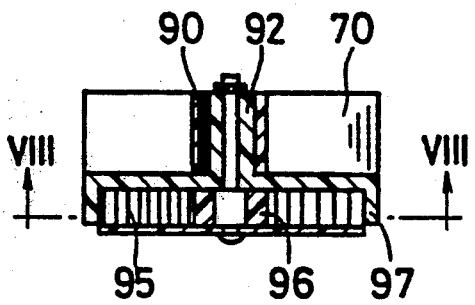
FIG. 7 is a cross sectional view showing a modification of the arrangement of FIG. 6.
Figure 8:
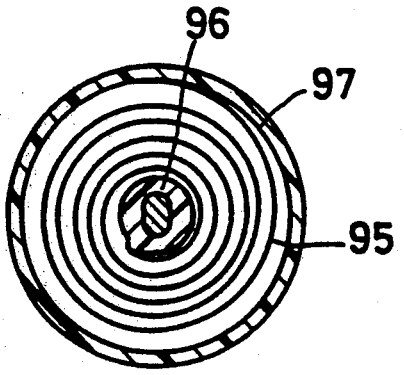
FIG. 8 is a cross sectional view taken along line VIII—VIII of FIG. 7.

In either of the two arrangements of FIG. 6 and FIGS. 7 and 8, the transparent tape 70 supplied from the supply spool 90 is turned by a guide roller 98 in its feed direction, and is past between the thermal head 72 and the platen roller 76. The portion of the transparent tape 70 on which the printing is effected by the thermal head 72 is further fed between a pair of mutually adjacently located presser rollers 99, 100 disposed downstream of the thermal head 72. The two presser rollers 99, 100 define therebetween a pressure nip through which is passed the printed portion of the tape 70 which bears the laterally reversed image.

A supply spool 104 is disposed on one of opposite sides of the ribbon cassette 78 which is remote from the supply spool 90 for the transparent tape 70. This supply spool 104 supports a roll of a backing tape 102 which includes a release layer. The supply spool 104 is fit on a spool shaft 106 for rotation therewith. Like the supply spool 90 for the transparent tape 70, the supply spool 104 is given a resistance to its rotation, by a mechanism similar to that shown in FIG. 6 or 7, whereby a free rotation of the roll of the backing tape 102 is avoided. The backing tape 102 supplied from the spool 104 is fed between the presser rollers 99, 100, so that the backing tape 102 adheres to the back surface of the printed portion of the transparent tape 70.

Figure 9:
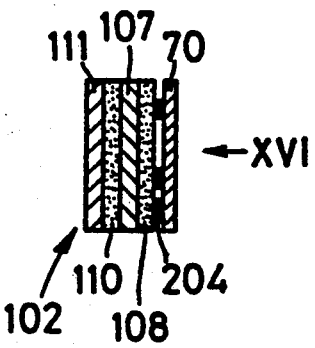
FIG. 9 is a cross sectional view showing a multi-layered tape produced by the tape printer, when operated in its first operating position.

As is apparent from FIG. 9, the backing tape 102 consists of a paper substrate 107, two adhesive layers 108, 110 formed on the opposite surfaces of the substrate 107, and a release layer 111 which covers the adhesive layer 110. The tape 102 is bonded at its adhesive layer 108 to the back surface of the printed portion of the tape 70, while the tapes 70, 102 are passed through the pressure nip of the presser rollers 99, 100.

The set of presser rollers 99, 100, and the platen roller 76 are selectively driven by a drive system, which will be described by reference to FIG. 10. Gears 112 and 114 are provided concentrically with the respective presser rollers 99, 100, so that the gears 112, 114 are rotated with the respective rollers 99, 100. The gears 112, 114 are arranged to be engageable with each other. The gear 114, and intermediate gears 116, 118 and 120 are rotatably supported on a gear lever 122, such that these gears 114, 116, 118, 120 establish a gear train wherein the gears mesh with each other in the order of description. A drive source in the form of a tape feeding motor 123 is provided such that a pinion 124 secured to the output shaft of the motor 123 is held in mesh with the intermediate gear 116, and another intermediate gear 126 which in turn meshes with a take-up gear 128 for the ribbon cassette 78. The take-up gear 128 is provided in concentric relation with the spool drive shaft 84 indicated above, as shown in FIG. 11. The take-up spool 82 of the ribbon cassette 78 is fit on the spool drive shaft 84. The take-up gear 128 and the spool drive shaft 84 are rotatable relative to each other, namely, the gear 128 slips on the shaft 84, when a torque exceeding a given limit is applied to the gear 128.

Figure 10:
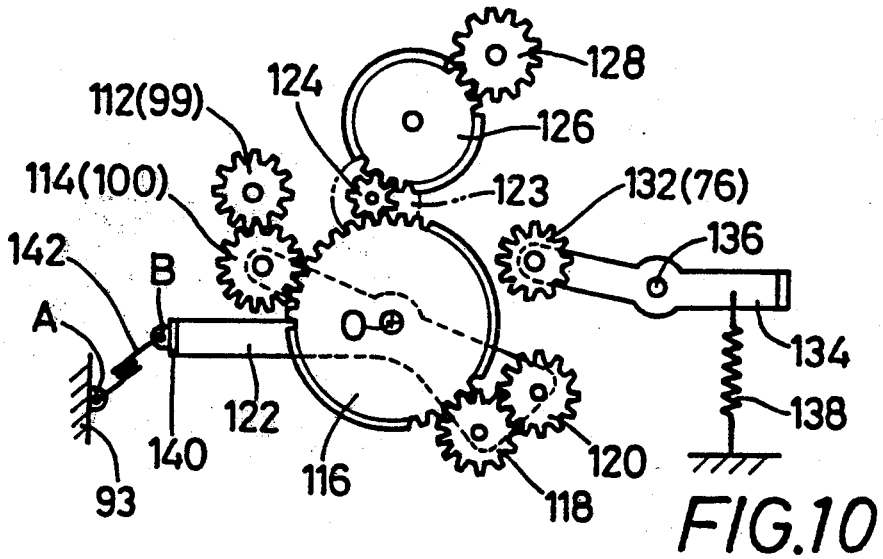
FIG. 10 is a view illustrating a drive system in the first operating position.
Figure 11:
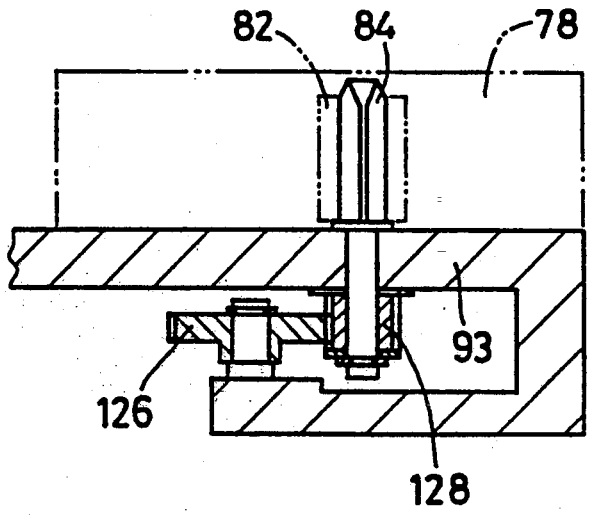
FIG. 11 is a fragmentary elevational view in cross section of the drive system of FIG. 10.

As shown in FIG. 10, a roller gear 132 is concentrically secured to the platen roller 76 of FIG. 2, for rotation therewith. This roller gear 132 is freely rotatably supported at one end of a platen roller lever 134. This lever 134 is pivotally supported at its intermediate portion by a vertically extending shaft 136, and is biased by a tension spring 138 in a direction that causes the platen roller 76 to be forced against the thermal head 72.

The above-indicated gear lever 122 is pivotable about an axis O which passes the center of the intermediate gear 116. The lever 122 has a first position of FIG. 10 in which the gear 114 on the lever 122 engages the gear 112. In this first position, the gear 120 on the lever 122 is disengaged from the roller gear 132 of the platen roller 76. From this first position, the gear lever 122 is pivoted counterclockwise to a second position of FIG. 12 in which the gear 114 is disengaged from the gear 112, while the gear 120 engages the gear 132 of the platen roller 76. The gears 112, 132 and the gear train 114, 116, 118, 120 are arranged so as to selectively establish the first and second positions of FIGS. 10 and 12, as described above.

The gear lever 122 has an operating portion 140 which extends upward from one end thereof through an arcuate slot (not shown) formed through the thickness of the covering 38 of the data input section 10 (FIG. 3). To the gear lever 122, there is connected a torsion spring 142 for maintaining the lever 122 selectively in one of the first and second positions described above. This torsion spring 142 is installed in pre-loaded condition such that the one end is fixed to the baseplate 93 of the printing section 14, while the other end is fixed to the end of the lever 122 from which the operating portion 140 extends. The above-indicated one end of the torsion spring 142 serves as a proximal or base end indicated at A in FIG. 10, while the other end serves as a distal or operating end indicated at B in FIG. 10. In the first position of FIG. 10, the operating end B of the torsion spring 142 is located on one of opposite sides of a straight line A-O (connecting the base end A and the pivot axis O of the lever 122), which one side is adjacent to the gear 122. The gear lever 122 is held in this first position under the clockwise biasing action of the spring 142. In the second position of FIG. 12, the operating end B of the torsion spring 142 is located on the other side of the straight line A-O remote from the gear 122. The lever 122 is held in this second position under the counterclockwise biasing action of the spring 142.

In the present embodiment, the tape feeding motor 123 serves as drive sources for both the tape feeding means and the ribbon feeding means. In the first position of the gear lever 122, the presser rollers 99, 100 driven by the respective gears 112, 114 serve as the feed rollers for feeding the transparent tape 70. In the second position of the gear lever 122, the platen roller 76 driven by the gear 132 serves as the feed roller for the tape feeding means. The path along which the transparent tape 70 supplied from the supply spool 90 is fed is defined by the guide roller 98, thermal head 72, platen roller 76 and presser rollers 99, 100. Further, it will be understood that the gear lever 122 supporting the gears 114, 116, 118, 120 and provided with the operating portion 140, cooperates with the torsion spring 142 to provide a switching device for selectively establishing the operating positions of the drive system of FIGS. 10 and 12, which correspond to the first and second positions of the lever 122.

Figure 13:
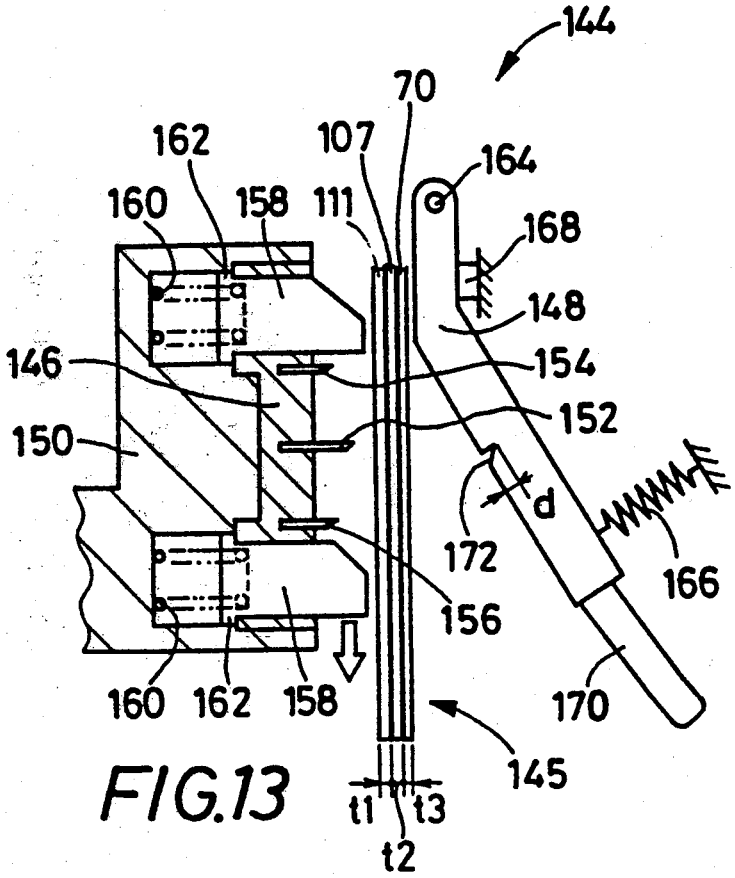
FIG. 13 is a plan view of a cutter mechanism incorporated in the tape printer.

Downstream of the presser rollers 99, 100 as viewed in the feeding direction of the transparent tape 70, there is disposed a cutter mechanism generally indicated at 144 in FIG. 2. The cutter mechanism 144 is adapted to cut a multi-layered tape 145 which consists of the printed transparent tape 70 and the backing tape 102 bonded to the tape 70. As shown in FIG. 13, the cutter mechanism 144 has a cutter holder 146 and a pressure plate 148 which are arranged such that the cutter holder 146 is on the side of the release layer 111 while the pressure plate 148 is on the side of the transparent tape 70.

The cutter holder 146 is secured to a stationary block 150 fixed to the baseplate 93 of the printing section 14. A completely cutting blade 152 is fixed to an intermediate portion of the cutter holder 146, such that the blade 152 extends toward the release layer 111 of the multi-layered tape 145. Further, two partially cutting blades 154, 156 are held by the cutter holder 146, on the upstream and downstream sides of the completely cutting blade 152 as viewed in the feeding direction (indicated by white arrow in FIG. 13) of the tape 145, such that the blades 154, 156 extend toward the release layer 111. The partially cutting blades 154, 156 are spaced a same distance from the completely cutting blade 152 in the feeding direction.

Figure 14:
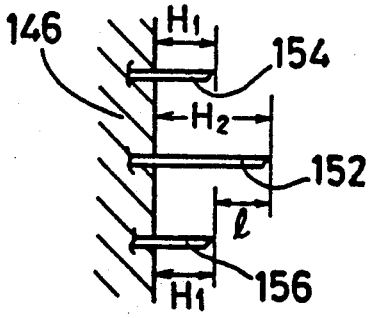
FIG. 14 is a plan view showing a cutting blade arrangement of the cutter mechanism.

As indicated in FIG. 14, the partially cutting blades 154, 156 have a same projection H1 from the surface of the cutter holder 146. This projection H1 is determined so as to cut only the release layer 111 which has a thickness t1. On the other hand, the completely cutting blade 152 has a projection H2 from the cutter holder 146. This projection H2 is determined so as to satisfy the following inequality:

$$H1+t2+t3 \leqq H2 < H1+t2+t3+d$$

where, t2: thickness of the substrate 107 t3: thickness of the transparent tape 70 d: depth of a notch 172 formed in the pressure plate 148

In the determination of the projection H2, the thicknesses of the adhesive layers 108, 110 are ignored.

Described differently, the tip of each partially cutting blade 154, 156 is spaced by a distance $l(l \geqq t2+t3)$ from the tip of the completely cutting blade 152 in the direction away from the release layer 111, so that the partially cutting blades 154, 156 are able to cut only the release layer 111. On the other hand, the completely cutting blade 152 is adapted to cut off the multi-layered tape 145, through its entire thickness which includes the thicknesses of the substrate 107 and transparent tape 70.

A pair of presser members 158 are supported by the cutter holder 146 such that the two presser members 158 are located symmetrically with respect to the completely cutting blade 152, on the opposite sides of the cutter holder 146. The presser members 158 are movable in a direction perpendicular to the surface of the release layer 111. Each presser member 158 is biased by a compression spring 160 in a direction toward the release layer 111, and is provided with a flange portion 162 at its rear end. The fully advanced position of the presser member 158 is determined by abutting contact of the flange portion 162 with the cutter holder 146. An amount of projection of each presser member 158 from the cutter holder 146 is larger than the projection H2 of the completely cutting blade 152, but is determined so as to avoid an interference of the blade 152 with the release layer 111.

The pressure plate 148 is supported pivotally about a shaft 164 toward and away from the cutting blades 152, 154, 156 and presser members 158, in a plane perpendicular to the direction of width of the multi-layered tape 145. While the pressure plate 148 is biased by a tension spring 166 in a direction away from the cutting blades 152, 154, 156, the retracted position of the pressure plate 148 is determined by a stop 168. The pressure plate 148 has at its free end an integrally formed lever 170, which is manipulated to pivot the pressure plate. The pressure plate 148 has a notch 172 formed in its surface which faces the transparent tape 70. The notch 172 is located in alignment with an extension line of the completely cutting blade 152, when the pressure plate 148 is in the operated position. The notch 172 accommodates the end portion of the completely cutting blade 152.

The thus constructed pressure plate 148 cooperates with the pair of presser members 158 to sandwich and retain the appropriate portion of the multi-layered tape 145, and force that portion of the tape 145 against cutting blades 152, 154, 156. Thus, the pressure plate 148 and the presser members 158 serve as a mechanism for giving a cutting motion to the tape 145. The axis of pivot 164 of the pressure plate 148 is located so that the plate 148 is parallel to the tape 145 when the plate 148 is in the cutting position. As shown in FIG. 1, the operating lever 170 projects out of the apparatus body 12, so that the lever 170 can be manipulated by the operator.

Figure 15:
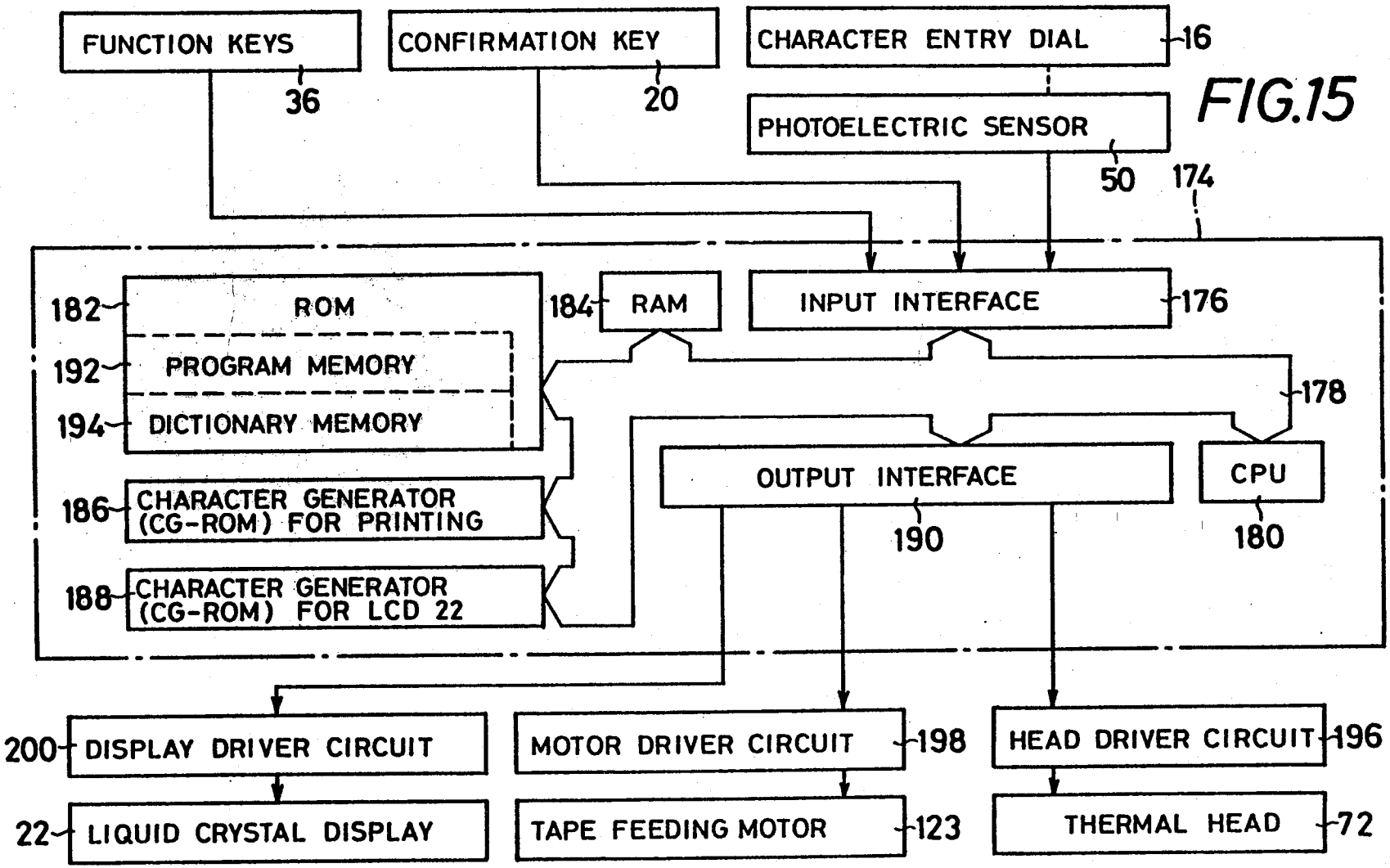
FIG. 15 is a schematic block diagram showing a control system of the tape printer of FIG. 1.

Referring next to the block diagram of FIG. 15, there is illustrated a control system for controlling the data input section 10 and printing section 14.

The photoelectric sensor 50 for detecting the angular position of the character entry dial 16, the CONFIRMATION key 20 for confirming the character selected by the dial 16, and the various function keys 36 are connected to an input interface 176 of a microcomputer 174. The input interface 176 is connected through a bus line 178 to a CPU (central processing unit) 180, a ROM (read-only memory) 182, a RAM (random-access memory) 184, character generators (hererinafter referred to as "CG-ROM") 186, 188, and an output interface 190.

The ROM 182 includes a PROGRAM memory 192 which stores a control program for controlling the operation of the instant tape printer, and a DICTIONARY memory 194 used for converting the "kana" words into the Chinese character words. The RAM 184 has various counters, registers and buffer memories. The CG-ROM 186 generates dot-matrix character patterns for printing characters, based on entered coded character data, and the CG-ROM 188 generates dot-matrix character patterns for displaying the characters on the liquid crystal display 22. To the output interface 190, there are connected a head driver circuit 196, a motor driver circuit 198 and a display driver circuit 200, which are connected to the thermal head 72, tape feeding motor 123 and liquid crystal display 22, respectively.

As described above, the thermal head 72 is disposed in the rear section of the apparatus body 12, such that the heat-generating elements of the head 72 face the back surface of the transparent tape 70. The transparent tape 70 is fed in the leftward direction as viewed in FIG. 1. However, the tape 70 is fed in the rightward direction when viewed in the direction from the thermal head 72 toward the back surface of the tape 70. Therefore, the dot-matrix character pattern data is read out from the CG-ROM 186 in the same order as in an ordinary thermal printer. Namely, the dot-matrix data sets for each character are read out, beginning with the data set representative of the leftmost column of the character, whereby the heat-generating elements of the thermal head 72 are selectively energized according to the dot-matrix data sets. As a result, an appropriate image is printed on the back surface of the transparent tape 70 (which faces the thermal head 72), such that the printed image as viewed in the direction B of FIG. 2 is laterally reversed with respect to a nominal desired image as viewed in the direction A of FIG. 2. Although the dot-matrix pattern data per se fed to the thermal head 72 and the order of reading of the data are the same as in an ordinary thermal printer for printing the nominal image (non-reversed image), the image printed by the thermal head 72 is laterally reversed, since the direction of feed of the tape 70 as viewed on the side of the thermal head 72 is reversed with respect to the tape feeding direction in the ordinary thermal printer. In the present embodiment, the CPU 180 constitutes a major portion of the control device for controlling the reverse printing of characters on the back surface of the tape 70.

There will next be described the operating of the instant tape printer.

After the tape printer is turned on, the character entry dial 16 is zeroed by pressing the CONFIRMATION key 20 while the indicia "あA" on the dial 16 are aligned with the pointer 18. Subsequently, the CPU 180 processes various signals.

To enter each desired character, the dial 16 is rotated to the appropriate angular position, and the OUT/IN selector key 25 is operated to designate one of the two rows of indicia in which the appropriate character indium is provided. Then, the CONFIRMATION key 20 is operated. As a result, the corresponding character data is fed to the microcomputer 174. The selected character aligned with the pointer 18 is displayed on the liquid crystal display 22, via the CG-ROM 188. Simultaneously, the dot-matrix character pattern data of the character to be printed is generated from the CG-ROM 186 and is stored in a print buffer (not shown) of the RAM 184. Upon operation of the PRINT key 35, the dot-matrix character pattern data is retrieved from the print buffer, and fed to the thermal head 72, whereby the corresponding image is printed on the transparent tape 70 such that the printed image as viewed in the direction B of FIG. 2 is laterally reversed to the nominal image as viewed in the direction A of the same figure. Since the operator sees the printed image as the normal nominal image, the operator can easily confirm the printed image.

Figure 12:
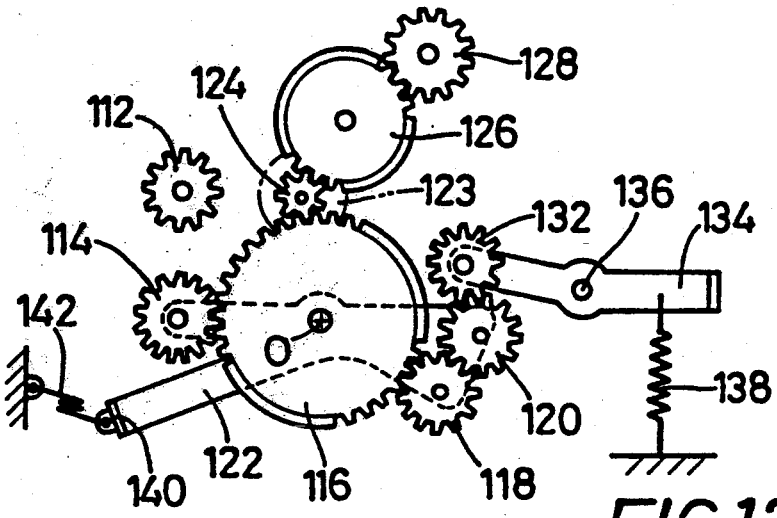
FIG. 12 is a view illustrating the drive system in the second operating position.

Prior to the printing operation indicated above, the drive system for feeding the transparent tape 70 is selectively placed in one of the first and second positions of FIGS. 10 and 12, depending upon whether the printed tape 70 is covered by the backing tape 102 or not.

When it is desired to cover the printed back surface of the transparent tape 70 with the backing tape 102, the gear lever 122 is set to the first position of FIG. 10, in which the gear 114 meshes with the gear 112. In this first position, the presser rollers 99, 100 are held in pressed contact with each other, while the intermediate gear 120 is disengaged from the roller gear 132.

As a result, the drive force of the tape feeding motor 123 is transmitted to the gears 114, 112 through the intermediate gear 116, whereby the presser rollers 99, 100 are rotated in the opposite directions while sandwiching the transparent tape 70. Accordingly, the tape 70 is pulled from the supply spool 90, and is fed past the thermal head 72 in timed relation with the printing action of the head 72. At the same time, the backing tape 102 is pulled from the supply spool 104. The platen roller 76 which is disconnected from the motor 123 is in pressed contact with the thermal head 72 via the tape 70 under the biasing action of the tension spring 138, whereby the platen roller 76 is rotated due to a friction force between the roller 76 and the tape 70 being fed. As indicated in FIG. 1, the presser roller 99 has guide flanges at its upper and lower ends, which serve to guide the tapes 70, 102, such that the upper and lower edges of the tapes contact the flanges. Thus, the tapes 70, 102 can be properly positioned in the direction of width. The circumferential surface between the two flanges of the presser roller 99 cooperates with the other presser roller 100 to nip and feed the tapes 70, 102.

Figure 16:
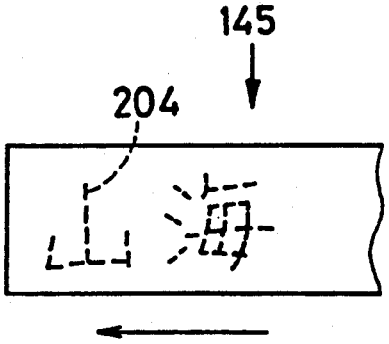
FIG. 16 is a view taken in a direction of arrow XVI of FIG. 9.

The presser rollers 99, 100, which serve to feed the tapes 70, 102, also function as a major part of the backing device for backing the printed tape 70 with the backing tape 102. Described more specifically, the transparent tape 70 and the backing tape 102 are superposed on each other by the rotating movements of the presser rollers 99, 100, and the backing tape 102 is bonded at its adhesive layer 108 to the printed back surface of the tape 70, through the aid of a pressure applied to the tapes 70, 102 from the rollers 99, 100 which are rotated in pressed rolling contact with each other under the biasing action of the torsion spring 142 (FIG. 10). Thus, the multi-layered tape 145 indicated above is produced. The laterally reversed image printed on the back surface of the tape 70 is indicated at 204 in FIG. 9. This image 204 is seen through the transparent tape 70 as the desired nominal image when viewed in the direction of arrow XVI, as indicated in FIG. 16 by way of example. The transparent tape 70 serves not only as a recording medium for bearing the image 204, but also as a tape for protecting the image 204 against rubbing.

The obtained multi-layered tape 145 is further fed by the rotating movements of the presser rollers 99, 100, to the cutter mechanism 144 of FIG. 13 disposed downstream of the rollers 99, 100. After the tape 145 is fed between the presser members 158 and the pressure plate 148 by a suitable distance, the tape feeding motor 123 is turned off and the feeding of the tape 145 is stopped.

Figure 17:
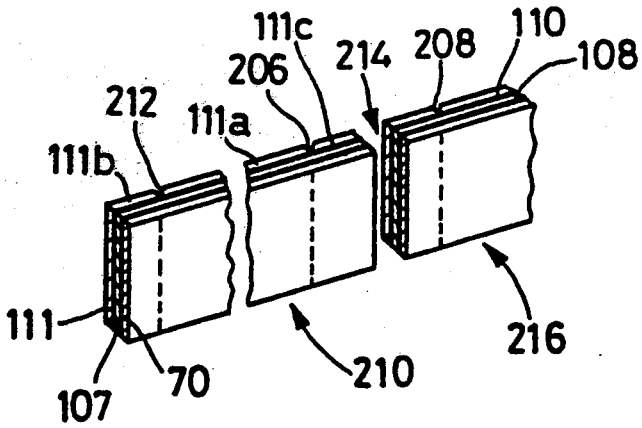
FIG. 17 is a perspective view of a segment of the printed tape obtained by cutting the tape by the cutter mechanism.

In this condition, the operating lever 170 is operated in the clockwise direction as viewed in FIG. 13, against the biasing force of the tension spring 166. Consequently, the tape 145 is completely severed by the completely cutting blade 152. Subsequently, only the release layer 111 is cut by the partially cutting blades 154, 156. Namely, cuts 206, 208 (FIG. 17) are formed through the thickness of the release layer 111. These cuts 206, 208 facilitate the removal of the release layer 111.

After the tape 145 is cut, the pressure plate 148 is returned to the original retracted position under the biasing action of the tension spring 166, and the presser members 158 are restored to their original position under the biasing action of the compression springs 160. Thus, the tape 145 is released from the cutter mechanism 144. In this condition, the tape 145 can be fed again.

With the leading end portion of the tape 145 cut by the cutter mechanism 144 as described above, a cut segment 210 as indicated in FIG. 17 is obtained. This cut segment 210 has two cuts 206, 212 adjacent to its opposite ends. Described more particularly, with one cutting operation by the cutter mechanism 144, the segment 210 is separated from the tape 145 by a cut 214 through the entire thickness of the tape 145, by the completely cutting blade 152. Simultaneously, the cuts 206, 208 through the release layer 111 are produced by the partially cutting blades 154, 156, on both sides of the complete cut 214. The cut 208 produced by the partially cutting blade 154 shown in FIG. 13 is provided in the leading end portion 216 of the tape 145, which is cut off as a cut segment in the next cutting operation. The cut 212 in the cut segment 210 was produced by the partially cutting blade 154 in the preceding cutting operation.

The thus prepared cut segment 210 is bonded to a suitable object, by removing the release layer 111. That is, the cut segment 210 is finger gripped at its opposite end portions and is flexed so that the ends of an intermediate portion 111*a* of the release layer 111 are separated from the adhesive layer 110. The intermediate portion 111*a* may be easily removed, by finger-gripping one of the separated ends. Then, the cut segment 210 is stretched and positioned on the object surface, with its end portions finger-gripped, while the exposed portion of the adhesive layer 110 is held slightly above the object surface. In the next step, the exposed portion of the adhesive layer 110 is forced against the object surface, and the remaining end portions 111*b*, 111*c* of the release layer 111 are removed. Since the intermediate portion of the cut segment 210 is already bonded to the object surface, there is no possibility of the segment 210 being shifted out of position when the exposed end portions of the adhesive layer 110 are bonded to the object surface. Thus, the positioning of the cut segment 210 on the object surface can be accomplished without the fingers contacting the adhesive layer 110, and the segment 210 can be bonded to the object surface, with substantially no contact of the fingers with the adhesive layer 110.

Where the printed transparent tape 70 is not covered or backed by the backing tape 102, the drive system for feeding the tape 70 is placed in the second position of FIG. 12. In this case, the supply spools 90, 104 of the transparent tape 70 and backing tape 102 which have been used in the first position of FIG. 10 are removed from the spool shafts 92, 106, and another supply spool 90 bearing a new roll of the transparent tape 70 is mounted on the spool shaft 92. When the supply spool 90 is removed and installed, the platen roller lever 134 (FIGS. 10 and 12) is pivoted in the counterclockwise direction against the biasing force of the tension spring 138, so as to produce a gap between the platen roller 76 and the thermal head 72. In this condition, the transparent tape 70 extending from the supply spool 90 can be readily removed from between the roller and head 76, 72 or passed therebetween. When the supply spool 104 is removed, the gear lever 122 is moved to the second position of FIG. 12, in which the presser rollers 99, 100 are spaced apart from each other. In this condition, the backing tape 102 extending from the supply spool 104 can be readily removed from between the rollers 99, 100. In this second position of FIG. 12, the gear 114 is disengaged from the gear 112 while the rollers 99, 100 are held apa.t from each other. At the same time, the intermediate gear 120 is in mesh with the gear 132 of the platen roller 76.

Figure 18:
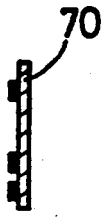
FIG. 18 is a cross sectional view of the printed tape produced by the tape printer when operated in its second operating position.

With the drive system placed in the second position of FIG. 12, the rotary movement of the tape feeding motor 123 is transmitted to the platen roller gear 132 via the intermediate gears 116, 118 and 120, whereby the platen roller 76 is rotated in the counterclockwise direction as viewed in FIG. 2. Accordingly, the transparent tape 70 is fed by the platen roller 76 in the longitudinal direction, while the thermal head 72 effects reverse printing on the transparent tape 70, as indicated in FIG. 18. Since the overall speed reduction ratio of the gear train between the pinion 124 of the motor 123 and the gear 132 is equal to that of the gear train between the pinion 124 and the gears 114, 112, the tape feeding speed in the second position of the drive system is equal to that in the first position.

The printed portion of the transparent tape 70 is passed between the presser rollers 99, 100. In the second position, however, the printed portion of the tape 70 is not fed by these rollers, since the roller 99 is disconnected from the motor 123 and the rollers 99, 100 are separated from each other. Further, the printed image on the tape 70 will not be rubbed, erased or otherwise influenced by the rollers 99, 100.

Like the multi-layered tape 145, the printed transparent tape 70 is cut by the cutting operation by the cutter mechanism 144, into segments having appropriate lengths. The tape 70 may be marred or damaged by the partially cutting blades 154, 156 if the operating lever 170 is further pivoted after the tape 70 is severed by the completely cutting blade 152. To avoid this inconvenience, it is effective to use a stop which is movable between an operated position and a retracted position. In the operated position, the stop prevents a further pivotal movement of the pressure plate 148 after the cutting of the tape 70 by the completely cutting blade 152, in order to avoid the contact between the partially cutting blades 154, 156 and the tape 70. In the retracted position, the stop does not function to stop the pressure plate 148. The stop is placed in the retracted position when the tape drive system is in the first position of FIG. 10, and in the operated position when the tape drive system is in the second position of FIG. 12.

The cut segment obtained from the printed tape 70 can be used to transfer the printed image to a desired object. Namely, the back surface of the segment bearing the laterally reversed image (as viewed toward the back surface) is forced into contact with the object surface, with a finger pressure applied to the ink material of the image through the segment (70), whereby the image can be transferred to the object surface. The transferred image is viewed as the desired nominal image. Thus, the cut segment can be conveniently used for a lettering work. The multi-layered tape 145 produced in the first position of FIG. 10 is applied by bonding to the object and may be considered an adhesive tape having a printed image, while the single-layer tape 70 produced in the second position of FIG. 12 may be considered a decalcomania tape from which the printed image is transferred to the object under pressure. Generally, it is desirable that the ink material of the ink ribbon 74 used for the single-layer decalcomania 70 have a higher degree of transferability, than the ink material for the multi-layered adhesive tape 145. In this case, the ribbon cassette 78 is also changed to use another type of ink ribbon 74, when the transparent and backing tapes 70, 102 are replaced by another transparent tape 70 upon changeover of the tape drive system from the first position to the second position. To further facilitate the transfer of the ink material from the printed tape 70 (produced in the second position) to the object surface, it is preferable that the wettability of the surface of the transparent tape 70 used in the second position be relatively low.

While the transparent tape 70 is used as a recording medium in the illustrated embodiment, it is possible to use a colored semi-transparent tape or other recording medium which permits a laterally reversed image printed on its back surface, to be seen through its thickness on the side of the front surface.

The paper-based substrate 107 used for the backing tape 102 may be replaced by other suitable materials such as a plastic film, which have a sufficient degree of transparency.

Further, the backing tape 102 of FIG. 9 may be replaced by a tape which has a single adhesive layer on a release layer. Namely, the substrate 107 and adhesive layer 110 may be eliminated from the tape 102 of FIG. 9.

In the illustrated embodiment described above, the platen roller 76 is operable to serve as means for feeding the tape 70. However, this roller 76 may be used solely as a platen for supporting the tape 70, and exclusive tape feed rollers may be provided downstream of the roller 76. In this case, the tape feed rollers are rotated only when the tape drive system is placed in the second position of FIG. 12. Similarly, the presser rollers 99, 100 may be used solely as a device for bonding the backing tape 102 to the printed tape 70, and exclusive feed rollers may be provided downstream of the rollers 99, 100.

Further, the presser rollers 99, 100 may be used only for producing the multi-layered adhesive tape 145, and another pair of feed rollers may be provided only for feeding the decalcomania tape 70. In this case, it is possible that at least one of the feed rollers has an axially intermediate portion which has a smaller diameter than the opposite end portions, so that the printed image will not contact the surfaces of the feed rollers. In this case, the tape 70 is fed by the feed rollers such that the upper and lower end width portions of the tape are held in pressed contact with the corresponding upper and lower end portions of the feed rollers. This feeding arrangement permits proper feeding of the tape 70 by the feed rollers, without the printed image being erased or otherwise influenced by the rollers.

In the above embodiment, the cutter mechanism 144 employs two partially cutting blades provided on both sides of the completely cutting blade. However, only one partially cutting blade may be provided on one side of the completely cutting blade, so that a single cut through the release layer 111 is formed in the cut segment or in the leading end portion of the tape 145. Further, the cutter mechanism 144 which uses the stationary cutting blades and the pressure plate may be replaced by a cutting arrangement wherein cutting blades are moved to cut the printed multi-layered tape.

The cutter mechanism 144 having the partially cutting blades as well as the completely cutting blade may be modified to have a single completely cutting blade. Further, the tape printer may not be provided with a cutter mechanism.

It will be understood that the principle of the instant tape printer adapted to print a laterally reversed image on the back surface of the substantially transparent tape 70 may be applied to a general type of recording apparatus wherein the print head is moved along a line of printing to effect printing on a transparent recording sheet, and the sheet is fed in the direction perpendicular to the direction of feed of the print head at the end of printing of each line.

Referring next to FIGS. 19–23, a modified embodiment of the present invention will be described. In the interest of brevity and simplification, the same reference numerals as used in the first embodiment will be used to identify the functionally corresponding elements, and only those portions of the present embodiment which differ from the above embodiment will be described.

Figure 19:
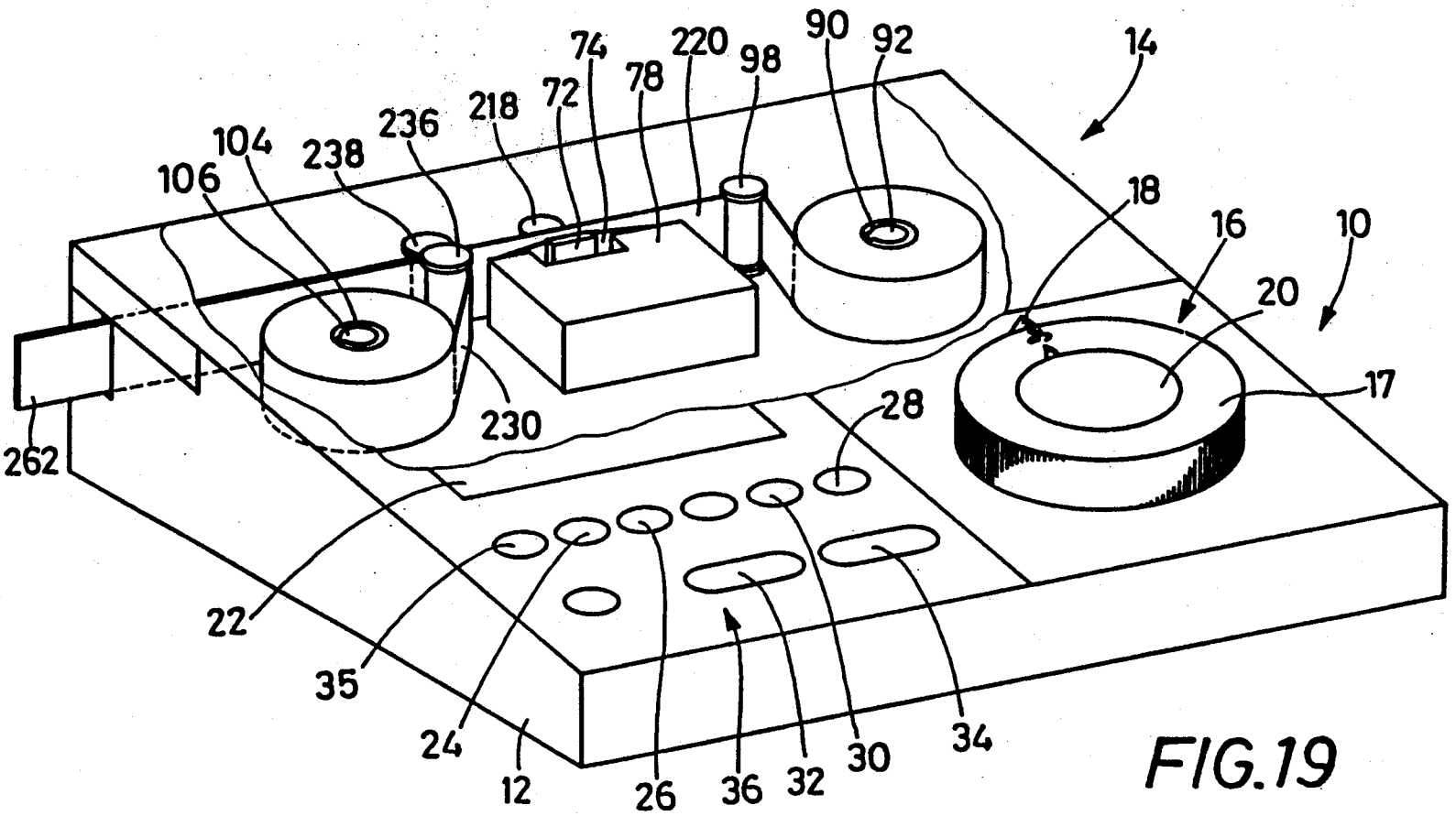
FIG. 19 is a partly cut-away view in perspective of a second embodiment of the tape printer of the invention.
Figure 20:
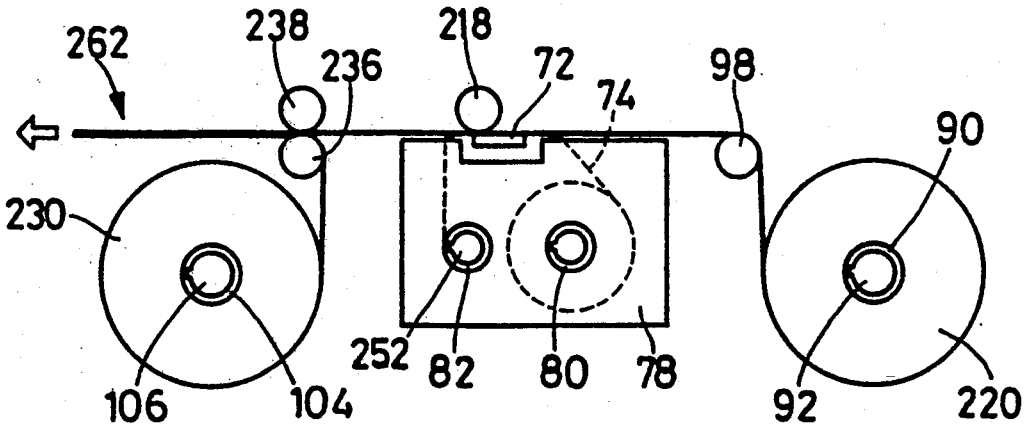
FIG. 20 is a fragmentary plan view of the tape printer of FIG. 19.

In the present modified embodiment, a recording medium in the form of a tape 220 with a release layer (hereinafter referred to as "recording tape") is supplied from the supply spool 90 and is fed in its longitudinal direction, past the recording thermal head 72, along a predetermined feed path defined through the printing section 14, as shown in FIGS. 19 and 20. In the instant tape printer, the thermal head 72 in the instant embodiment is positioned such that its row of heat-generating elements faces the front surface of the recording tape 220, contrary to the thermal head 72 of the preceding embodiment which faces the back surface of the tape 70. The thermal head 72 prints a normally oriented (non-laterally-reversed) image on the front surface of the recording tape 220, as in an ordinary printer. The instant tape printer uses a platen roller 218 which functions solely as a platen for supporting the recording tape 220. The platen roller 218 is freely rotatably supported and is biased by a suitable biasing device (not shown) toward the thermal head 72, so that the ink ribbon 74 and the recording tape 70 are forced by the platen roller 218 against the heat-generating elements of the thermal head 72.

Figure 21:
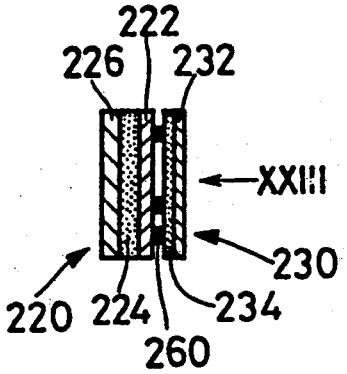
FIG. 21 is an elevational view in cross section of a printed tape covered by a protective tape, which is produced by the tape printer of FIG. 19.

As shown in the cross sectional view of FIG. 21, the recording tape 220 consists of a paper-based substrate 222, an adhesive layer 224 formed on the substrate 222, and a release layer 226 covering the adhesive layer 224. In FIG. 21, the thicknesses of the individual layers of the tape 220 are enlarged for easy understanding.

A roll of a transparent covering tape 230 is supported by the supply spool 104 which is disposed on the side of the ribbon cassette 78 remote from the supply spool 90 for the recording tape 220. This covering tape 230 consists of a transparent film layer 232, and a transparent adhesive layer 234 formed on the film layer 232, as shown in FIG. 21. The covering tape 230 is bonded at its adhesive layer 234 to the printed front surface of the recording tape 220, by means of rollers 236, 238.

Figure 22:
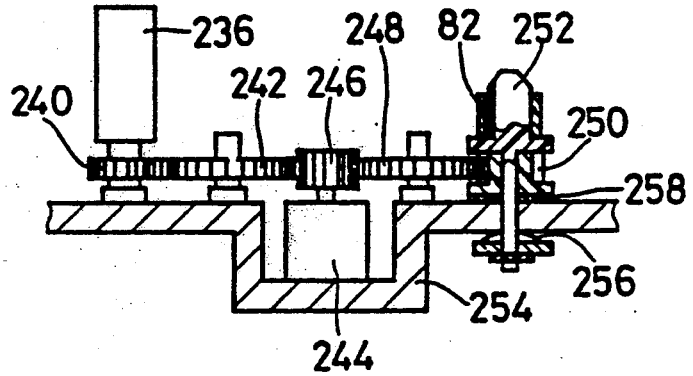
FIG. 22 is an elevational view in cross section of a tape feeding and ink ribbon take-up drive mechanism of the tape printer of FIG. 19.

The rollers 236, 238 are biased toward each other, and are rotated in the opposite directions. A drive system for driving these rollers 236, 238 is illustrated in FIG. 22. The drive system includes a gear 240 rotated with the roller 236, and a gear (not shown) rotated with the roller 238. The gear 240 is connected through an intermediate gear 242 to a pinion 246 fixed to the output shaft of a tape feeding motor 244. The pinion 246 is connected through an intermediate gear 248 to a take-up gear 250. The take-up gear 250 is formed concentrically and integrally with a spool drive shaft 252.

The take-up spool 82 of the ribbon cassette 78 is fixedly fit on the spool drive shaft 252. A spring washer 256 and a felt member 258 are disposed between the spool drive shaft 252 and a baseplate 254 of the apparatus body 12. The take-up gear 250 may slip on the spool drive shaft 252 when a torque exceeding a given value is applied to the take-up gear 250.

Figure 23:
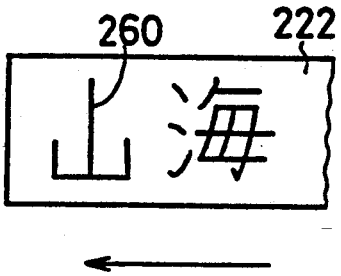
FIG. 23 is a view taken in a direction of of arrow XXIII of FIG. 21.

An operation of the instant tape printer to print characters "[illegible]" on the recording tape 220 as indicated in FIG. 23 will be described. Initially, the character entry dial 16 is rotated until the indicia "[illegible]" on the indicator surface 17 is aligned with the pointer 18. The microcomputer 174 receives a signal from the photoelectric sensor 50, and determines the character aligned with the pointer 18, based on the rotating direction and amount of the dial 16 which are determined based on the received signal. The determined character is displayed on the liquid crystal display 22.

The dot-matrix pattern data representative of the Japanese "kana" letter "[illegible]" is temporarily stored in the input buffer of the RAM 184, when the CONFIRMATION key 20 is pressed while the indicia "[illegible]" is aligned with the pointer 18. At the same time, the cursor on the display 22 is moved one position to the right from under the displayed letter "[illegible]".

Similarly, the next Japanese "kana" letter "[illegible]" is selected and entered. Then, the data representative of the entered Japanese "kana" word "[illegible]" is converted into the data representative of the corresponding Chinese character "[illegible]", by operating the KANA/CHINESE CHARACTER conversion key 32. The data of the Chinese character "[illegible]" is stored in the print buffer of the RAM 184. Similar procedure is used for the Chinese character "[illegible]".

With the PRINT key 35 operated, the Chinese characters "[illegible]" are printed in this order on the recording tape 220. More specifically, the heat-generating elements of the thermal head 72 are selectively energized according to the data stored in the print buffer, in timed relation with the feeding movement of the tape 220 by the rollers 236, 238. Consequently, the ink material is transferred from the local portions of the ink ribbon 74 corresponding to the energized heat-generating elements, to the substrate 222 of the recording tape 220, whereby an image 260 is produced as indicated in FIGS. 21 and 23. While the tape 220 is fed by the rollers 236, 238, the protective covering tape 230 is superposed on the printed portion of the tape 220 and passed through the pressure nip of the rollers 236, 238, together with the tape 220. The protective covering tape 230 is wound as a roll on the supply spool 104 such that the transparent film layer 232 is on the inner side of the roll while the adhesive layer 234 is on the outer side. Therefore, the protective covering tape 230 is delivered so that the adhesive layer 234 comes into contact with the printed front surface of the recording tape 220, i.e., the surface of the substrate 222 which bears the printed image 260. With the thus superposed tapes 220, 230 passed through the pressure nip of the rollers 236, 238, these tapes 220, 230 are bonded together into a printed multi-layered tape 262, as indicated in FIGS. 19 and 20. The prepared multi-layered tape 262 is cut into segments by a suitable cutting device disposed downstream of the rollers 236, 238.

In the present modified embodiment, the rollers 236, 238 and tape feeding motor 244 for feeding the tape 220 also serve as covering means for covering the printed surface of the recording tape 220 by the transparent protective covering tape 230.

The multi-layered tape 262 having the printed tape 220 protected by the covering tape 230 may be easily stuck at its adhesive layer 224, on the surface of a desired object, by removing the release layer 226. However, the adhesive layer 224 and release layer 226 are not essential elements of the recording tape 220.

Figure 24:
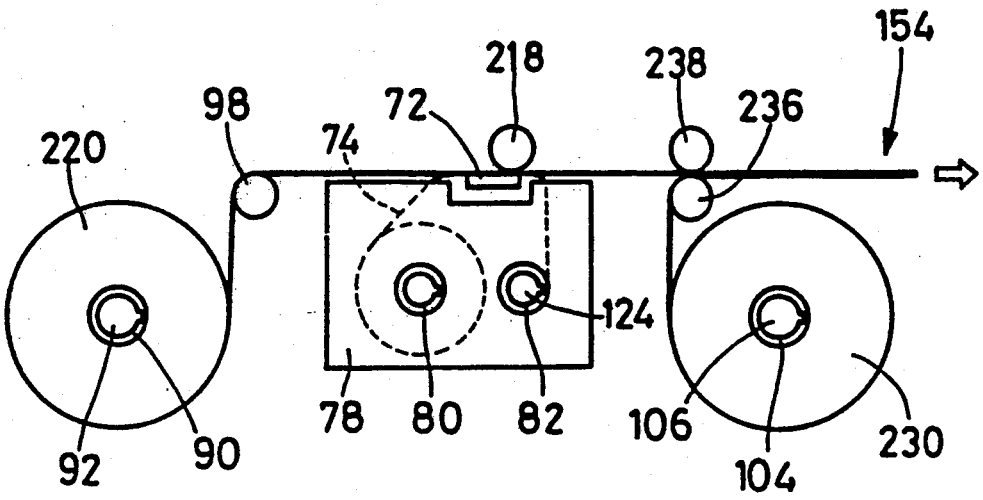
FIG. 24 is a fragmentary plan view of a further embodiment of the tape printer of the invention.
Figure 25:
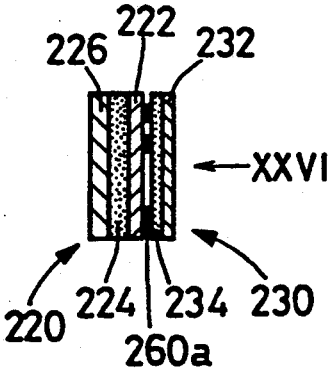
FIG. 25 is an elevational view in cross section of a printed tape covered by a protective tape, which is produced by the tape printer of FIG. 24.
Figure 26:
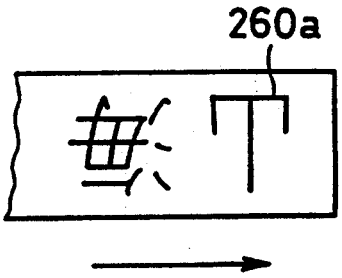
FIG. 26 is a view taken in a direction of arrow XXVI of FIG. 25.

In the present second embodiment, the recording tape 220 is fed to the left as viewed in the direction from the thermal head 72 toward the front surface of the tape 220, and the characters are normally printed by the thermal head 72, as normally seen by the reader, in the order of entry of the characters. In this arrangement, the operator of the printer can easily confirm the printed characters on the tape 220. However, the recording tape 220 may be fed to the right as viewed in the direction from the head 72 toward the tape surface, as in a modified embodiment of FIG. 24. In this instance, the positions of the supply spools 90, 104, rollers 98, 218, 236, 238 and ribbon cassette 78 are laterally reversed with respect to the arrangement of FIG. 20. Further, the image printed on the recording tape 220 is vertically inverted as indicated at 260a in FIGS. 25 and 26, with respect to the image 260 produced according to the preceding embodiment of FIGS. 19–23. The inversion is effected by the character generator CG-ROM 186.

In the embodiments of FIGS. 19–26, the transparent protective covering tape 230 is bonded to the recording tape 220 by an adhesive of the adhesive layer 234. However, the protective covering tape 230 may be replaced by a covering tape which is softened by heat and secured to the tape 220 under pressure.

While the rollers 236, 238 serve not only as the tape feeding device but also as the device for applying the covering tape 230 to the tape 220, it is possible that the rollers 236, 238 are freely rotatably supported and serve solely for applying the tape 230 to the tape 220, and an exclusive pair of feed rollers are provided downstream of the rollers 236, 238, such that the feed rollers are positively driven for feeding the tapes 220, 230.

Further, the protective covering tape need not be transparent and may be a semi-transparent tape or other suitable material which has a sufficient degree of transparency. Furthermore, the paper-based substrate 222 of the recording tape 220 may be replaced by a transparent film layer or other transparent layer.

While the present invention has been described in its presently preferred embodiments, it is to be understood that the invention may be embodied with various changes, modifications and improvements, which may occur to those skilled in the art.

What is claimed is:

1. A recording apparatus, comprising:

a recording tape having a first adhesive layer formed on one of opposite surfaces thereof, and a release layer covering said first adhesive layer;

a tape feeding device for feeding said recording tape in a longitudinal direction of said tape;

a recording head for recording an image including a plurality of characters on the other of said opposite surfaces of said recording tape, said recording head being disposed between said recording tape and a front portion of the recording apparatus, said recording head recording said plurality of characters in sequence in said longitudinal direction such that a vertical direction defined by each of said characters is substantially perpendicular to said longitudinal direction;

a substantially transparent covering tape for covering said other surface of said recording tape on which said image is recorded, said covering tape having a second adhesive layer; and a pair of presser rollers disposed downstream of said recording head as viewed in a direction of feed of said recording tape by said tape feeding device, said presser rollers defining therebetween a pressure nip through which are passed a recorded portion of said recording tape having said image recorded thereon and said covering tape, so that said covering tape is bonded at said second adhesive layer to said other surface of said recorded portion of said recording tape.

2. A recording apparatus according to claim 1, further comprising covering tape supply means including a supply spool having a roll of said covering tape mounted thereon, said covering tape supply means feeding said covering tape from said supply spool to said pressure nip of said pair of presser rollers.

3. A recording apparatus according to claim 2, wherein said covering tape supply means includes means for applying a resistance to a movement of said covering tape.

4. A recording apparatus according to claim 1, further comprising recording tape supply means including a supply spool having a roll of said recording tape mounted thereon, said tape feeding device feeding said recording tape from said supply spool to said pressure nip of said pair of presser rollers.

5. A recording apparatus according to claim 4, wherein said recording tape supply means includes means for applying a resistance to a movement of said recording tape.

6. A recording apparatus according to claim 1, further comprising an ink ribbon carrying an ink material, and ink ribbon supply means for supplying said ink ribbon such that said ink ribbon is superposed on said recording tape so that said recording head records said image on said recording tape by transferring said ink material from said ink ribbon to said other surface of said recording tape.

7. A recording apparatus according to claim 6, wherein said ink ribbon supply means includes means for applying a resistance to a movement of said ink ribbon.

8. A recording apparatus according to claim 6, wherein said ink ribbon supply means includes a supply spool having a roll of said ink ribbon mounted thereon, said apparatus further comprising ink ribbon feeding means having a take-up spool, for feeding said ink ribbon from said supply spool of said ink ribbon supply means to said take-up spool, past said recording head.

9. A recording apparatus according to claim 8, wherein said tape feeding device and said ink ribbon feeding means comprise a common drive motor for rotating at least one of said presser rollers, and said take-up spool.

10. A recording apparatus, comprising:

a recording tape having a first adhesive layer formed on one of opposite surfaces thereof, and a release layer covering said first adhesive layer;

a stationary recording head for recording an image on the other of said opposite surfaces of said recording tape, said recording head being disposed between said recording tape and a front portion of the recording apparatus;

a tape feeding device for feeding said recording tape in a longitudinal direction of said tape from right to left relative to said front portion, while said image is recorded by said recording head in said longitudinal direction;

a substantially transparent covering tape for covering said other surface of said recording tape on which said image is recorded, said covering tape having a second adhesive layer; and a pair of presser rollers disposed downstream of said recording head as viewed in a direction of feed of said recording tape by said tape feeding device, said presser rollers defining therebetween a pressure nip through which are passed a recorded portion of said recording tape having said image recorded thereon and said covering tape, so that said covering tape is bonded at said second adhesive layer to said other surface of said recorded portion of said recording tape.

11. A recording apparatus according to claim 10, wherein said recording head is operable to record a plurality of characters on said other surface of the recording tape such that said plurality of characters are arranged in said longitudinal direction and such that a vertical direction of said of said characters is substantially perpendicular to said longitudinal direction.

12. A recording apparatus according to claim 10, further comprising covering tape supply means including a supply spool having a roll of said covering tape mounted thereon, said covering tape supply means feeding said covering tape from said supply spool to said pressure nip of said pair of presser rollers.

13. A recording apparatus according to claim 12, wherein said covering tape supply means includes means for applying a resistance to a movement of said covering tape.

14. A recording apparatus according to claim 10, further comprising recording tape supply means including a supply spool having a roll of said recording tape mounted thereon, said tape feeding device leftwardly feeding said recording tape from said supply spool to said pressure nip of said pair of presser rollers.

15. A recording apparatus according to claim 14, wherein said recording tape supply means includes means for applying a resistance to a movement of said recording tape.

16. A recording apparatus according to claim 10, further comprising an ink ribbon carrying an ink material, and ink ribbon supply means for supplying said ink ribbon such that said ink ribbon is superposed on said recording tape by transferring said ink material from said ink ribbon to said other surface of said recording tape.

17. A recording apparatus according to claim 16, wherein said ink ribbon supply means includes means for applying a resistance of a movement of said ink ribbon.

18. A recording apparatus according to claim 16, wherein said ink ribbon supply means includes a supply spool having a roll of said ink ribbon mounted thereon, said apparatus further comprising ink ribbon feeding means having a take-up spool, for feeding said ink ribbon from said supply spool of said ink ribbon supply means to said tape-up spool, past said recording head.

19. A recording apparatus according to claim 18, wherein said tape feeding device and said ink ribbon feeding means comprise a common drive motor for rotating at least one of said presser rollers, and said take-up spool.

20. A recording apparatus, comprising:

a recording tape having a first adhesive layer formed on one of opposite surfaces thereof, a release layer covering said first adhesive layer;

a stationary recording head for recording an image on the other of said opposite surfaces of said recording tape, said recording head being disposed between said recording tape and a front portion of the recording apparatus;

a tape feeding device for feeding said recording tape in a longitudinal direction of said tape and in tape feeding direction such that the image is printed in the longitudinal direction and a vertical direction of the image is substantially perpendicular to the longitudinal direction;

a substantially transparent covering tape for covering said other surface of said recording tape on which said image is recorded, said covering tape having a second adhesive layer; and a pair of presser rollers disposed downstream of said recording head as viewed in the tape feeding direction of said recording tape by said tape feeding device, said presser rollers defining therebetween a pressure nip through which are passed a recorded portion of said recording tape having said image recorded thereon and said covering tape, so that said covering tape is bonded at said second adhesive layer to said other surface of said recorded portion of said recording layer.

21. A recording apparatus of claim 20, wherein the tape feeding direction is from right to left as viewed by the operator.

22. The recording apparatus of claim 21, wherein the image oriented in the vertical direction is capable of being read by the operator, and the recording head records the image oriented in the vertical direction on the other of the opposite surfaces of said recording tape.

23. The recording apparatus of claim 20, wherein the tape feeding direction is from left to right as viewed by the operator.

24. The recording apparatus of claim 23, wherein the recording head records the image on the other of the opposite surfaces of the recording tape in an orientation inverted relative to the vertical direction.

* * * * *